US008845214B2

(12) United States Patent
Hata

(10) Patent No.: US 8,845,214 B2
(45) Date of Patent: Sep. 30, 2014

(54) CONVEYING DEVICE AND PRINTER

(75) Inventor: Yoshitaka Hata, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 150 days.

(21) Appl. No.: 13/316,347

(22) Filed: Dec. 9, 2011

(65) Prior Publication Data

US 2012/0153000 A1 Jun. 21, 2012

(30) Foreign Application Priority Data

Dec. 16, 2010 (JP) ..... 2010-280375

(51) Int. Cl.
*B41J 11/00* (2006.01)

(52) U.S. Cl.
CPC ..... *B41J 11/009* (2013.01)
USPC ..... 400/605; 399/389; 271/9.1; 226/4; 226/45; 226/108

(58) Field of Classification Search
CPC ..... B41J 11/009; B41J 11/485; B41J 11/48; B65H 2301/12; B65H 2511/416; G03G 2215/00447; G03G 2215/0021
USPC ..... 399/389; 400/605; 271/9.1; 226/4, 10, 226/45, 108; 358/449
See application file for complete search history.

(56) References Cited

U.S. PATENT DOCUMENTS

2012/0056365 A1* 3/2012 Kato ..... 271/9.1

FOREIGN PATENT DOCUMENTS

JP 07031391 U * 6/1995 ..... B43L 13/00
JP 2000-117691 A 4/2000

OTHER PUBLICATIONS

Machine Translation of JP Publ. No. 2000-1117691 to Igarashi et al. published on Apr. 25, 2000.*

* cited by examiner

*Primary Examiner* — Daniel J Colilla
*Assistant Examiner* — Blake A Tankersley
(74) *Attorney, Agent, or Firm* — Canon USA Inc IP Division

(57) ABSTRACT

A conveying device includes a first feeder that rotatably supports a roll sheet and feeds the roll sheet to a conveying path, a second feeder that feeds a cut sheet to the conveying path, and a controller that determines whether a sheet fed to the conveying path is the roll sheet or the cut sheet based on the relationship between movement of the sheet fed to the conveying path and rotation of the roll sheet.

11 Claims, 5 Drawing Sheets

CONVEYING DEVICE AND PRINTER

BACKGROUND OF THE INVENTION

1. Field of the Invention

The present invention relates to printers that can perform recording on both roll sheets and cut sheets, and to conveying devices included in such printers.

2. Description of the Related Art

Printers that are capable of performing recording on both roll sheets and cut sheets are known. A printer of this type has two operation modes, which are a roll-sheet operation mode and a cut-sheet operation mode. Specifically, the printer has a roll-sheet mode for cutting and discharging a roll sheet upon completion of recording performed on the roll sheet and a cut-sheet mode for discharging a cut sheet upon completion of recording performed on the cut sheet. Furthermore, the printer has a mode setting unit for setting the operation mode to one of the two modes.

However, the following problem occurs if the matching between the set mode and the actually set sheet is incorrect. Specifically, if a roll sheet is set when the operation mode is set to the cut-sheet mode, the trailing edge of the sheet cannot be detected during the discharging process, resulting in continuous feeding of the roll sheet. On the other hand, if a cut sheet is set when the operation mode is set to the roll-sheet mode, the cut sheet would be cut during the discharging process.

Japanese Patent Laid-Open No. 2000-117691 discloses a technology in which a sheet detector for detecting the length of a set sheet is provided to automatically determine whether the matching between the set operation mode and the set sheet is appropriate based on the length of the sheet (sheet length) detected by the sheet detector.

However, in the technology disclosed in Japanese Patent Laid-Open No. 2000-117691, the sheet length is detected, and if the detected sheet length is smaller than a reference value, the sheet is determined that it is a cut sheet. Therefore, if the length of the cut sheet is larger than the reference value, it would be determined that the sheet is a roll sheet even though the sheet is actually a cut sheet, possibly resulting in an incorrectly set mode. Furthermore, the aforementioned technology requires a device for detecting the sheet length and also requires enough time for detecting the sheet length. This is problematic in that the cost of the printer may increase and the time required for the sheet setting process may become longer.

SUMMARY OF THE INVENTION

The present invention allows for automatic setting of an appropriate operation mode to avoid an incorrectly set operation mode.

A conveying device according to an aspect of the present invention includes a first feeder that rotatably supports a roll sheet and feeds the roll sheet to a conveying path, a second feeder that feeds a cut sheet to the conveying path, and a controller that determines whether a sheet fed to the conveying path is the roll sheet or the cut sheet based on the relationship between movement of the sheet fed to the conveying path and rotation of the roll sheet.

According to the present invention, since an appropriate operation mode is automatically set, an incorrectly set operation mode can be avoided.

Further features of the present invention will become apparent from the following description of exemplary embodiments with reference to the attached drawings.

DESCRIPTION OF THE EMBODIMENTS

Figure 1A:
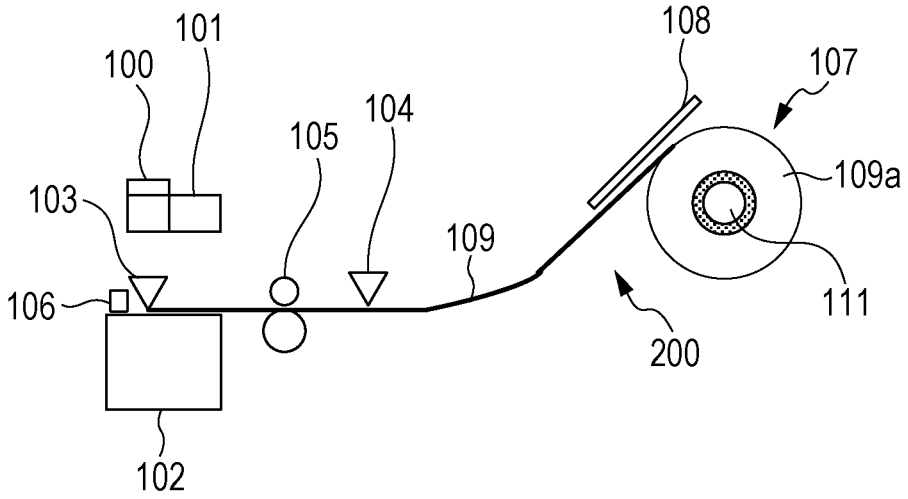
FIGS. 1A and 1B schematically illustrate a printer according to an embodiment of the present invention.
Figure 1B:
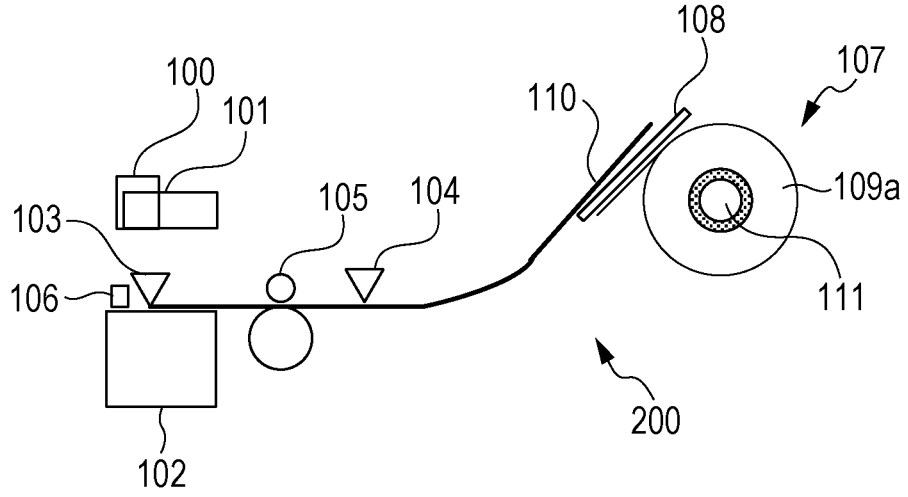

An embodiment of the present invention will be described below with reference to the drawings. FIGS. 1A and 1B schematically illustrate a printer 200 according to this embodiment. Specifically, FIG. 1A illustrates a state where a roll sheet is set, whereas FIG. 1B illustrates a state where a cut sheet is set.

In FIGS. 1A and 1B, reference numeral 100 denotes a recording head that ejects ink, 101 denotes a carriage that carries the recording head 100 and that reciprocates perpendicularly to the plane of FIGS. 1A and 1B, and 102 denotes a platen that supports a sheet. The printer 200 performs recording (printing) by ejecting ink from the recording head 100 onto the sheet supported by the platen 102 while reciprocating the carriage 101.

In FIGS. 1A and 1B, reference numerals 103 and 104 denote sheet sensors serving as detectors that detect whether there is a sheet in a conveying path, and 105 denotes a pair of rollers (i.e., a pair of sheet conveying rollers) for nipping and conveying a sheet. At least one of the sheet conveying rollers 105 is movable away from the other roller. The lower roller of the sheet conveying rollers 105 is a conveying roller that is driven and rotated by a conveying motor 222. In a state where a sheet is nipped between the sheet conveying rollers 105, one of the conveying rollers actively rotates to convey the sheet.

Furthermore, in FIGS. 1A and 1B, reference numeral 106 denotes a sheet cutter that cuts a sheet, 107 denotes a roll-sheet conveying unit, 108 denotes a cut-sheet guide that supports a cut sheet, 109 denotes a roll sheet serving as a continuous recording medium, and 110 denotes a cut sheet. The roll-sheet conveying unit 107 serves as a first feeder (support unit) that rotatably supports the roll sheet 109 and feeds the roll sheet 109 to the conveying path. The cut-sheet guide 108 serves as a second feeder that feeds the cut sheet 110 to the conveying path.

The roll-sheet conveying unit 107 performs a first operation for rotating a rolled section 109*a* of the roll sheet 109 in a direction for unwinding the roll sheet 109, and a second operation for rotating the rolled section 109*a* in a direction for rewinding the roll sheet 109 around the rolled section 109*a*. Specifically, the roll-sheet conveying unit 107 has a spool 111 that is fitted to a core of the roll sheet 109 and a spool motor 221 (see FIG. 2) that rotates the spool 111. By using the spool motor 221 to rotate the spool 111 in the forward or reverse direction, the rolled section 109*a* is rotated in the unwinding direction or the rewinding direction of the roll sheet 109. In FIGS. 1A and 1B, when the spool 111 rotates counterclockwise (in the forward direction), the roll sheet 109 is unwound from the rolled section 109*a* so that the unwound roll sheet 109 is conveyed leftward from the right side in the drawing. On the other hand, when the spool 111 rotates clockwise (in the reverse direction), the roll sheet 109 is rewound around the rolled section 109*a*.

The roll sheet 109 conveyed by the roll-sheet conveying unit 107 or the cut sheet 110 placed on the cut-sheet guide 108 is guided to the conveying path (conveying section). When the leading edge of the roll sheet 109 or the cut sheet 110 guided to the conveying path is detected by the first sheet sensor 104, the pair of sheet conveying rollers 105 starts rotating so as to convey the sheet leftward in the drawing. Subsequently, when the sheet is detected by the second sheet sensor (detector) 103, the pair of sheet conveying rollers 105 temporarily stops rotating, so that the sheet setting process is completed.

As described above, the roll-sheet conveying unit 107 is a designated conveying unit for conveying the roll sheet 109. In contrast, the pair of sheet conveying rollers 105 is a common conveying unit that conveys both the roll sheet 109 and the cut sheet 110 as recording media in a single conveying path.

The pair of sheet conveying rollers 105 serving as a common conveying unit is disposed downstream of the roll-sheet conveying unit 107 in the sheet conveying direction. Moreover, in the conveying path, the second sheet sensor 103 serving as a detector is disposed downstream of the pair of sheet conveying rollers 105 in the sheet conveying direction.

When printing performed on the roll sheet 109 or the cut sheet 110 conveyed to a recording area of the recording head 100 in the above-described manner is completed, the printer 200 switches to a discharging process. Specifically, when in a roll-sheet mode, the roll sheet 109 is cut by the sheet cutter 106 upon completion of the printing performed on the roll sheet 109. Subsequently, the pair of sheet conveying rollers 105 rotates so as to convey the remaining roll sheet leftward, whereby the cut and printed roll sheet is pushed leftward to a discharge unit. Then, the remaining roll sheet is conveyed rightward by the pair of sheet conveying rollers 105, and the spool 111 rotates clockwise so as to rewind the remaining roll sheet. On the other hand, when in a cut-sheet mode, the pair of sheet conveying rollers 105 rotates upon completion of the printing performed on the cut sheet 110 so as to convey and discharge the printed cut sheet 110 leftward to the discharge unit. In this case, the sheet cutter 106 is not activated.

Figure 2:
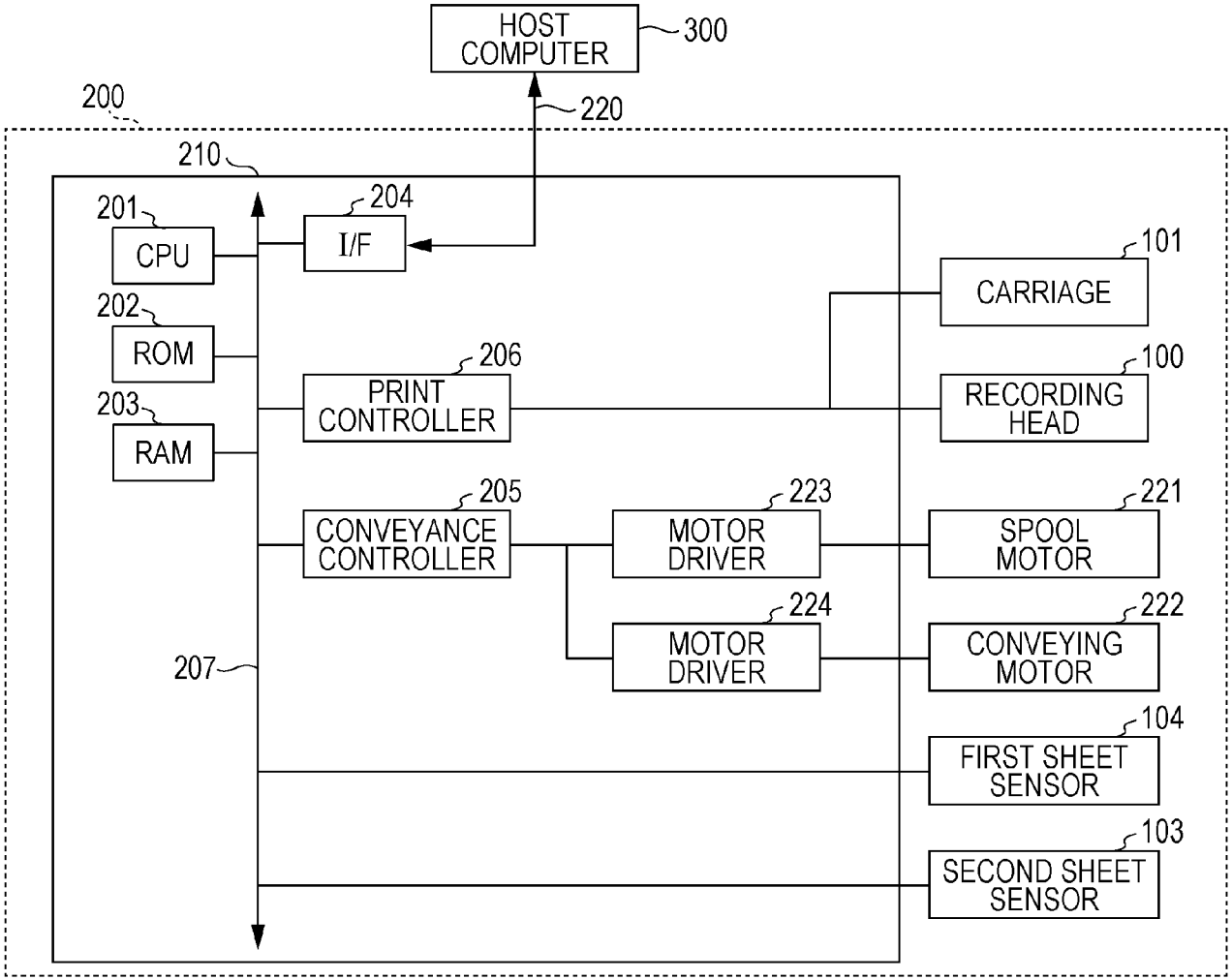
FIG. 2 is a block diagram schematically illustrating the system configuration of the printer according to the embodiment of the present invention.

FIG. 2 is a block diagram illustrating the configuration of the printer 200 according to the present embodiment. In FIG. 2, reference numeral 300 denotes a host computer, and 220 denotes a communication cable, such as a USB cable or a network cable. Print data is transmitted to the printer 200 from the host computer 300 via the communication cable 220. The printer 200 has a controller 210 serving as a control unit that includes a central processing unit (CPU) 201, a read-only memory (ROM) 202, a random access memory (RAM) 203, an interface (I/F) 204, a conveyance controller 205, and a print controller 206. The CPU 201 controls the overall operation of the printer 200. The ROM 202 contains a firmware program for controlling the printer 200 and a boot program for controlling the firmware program, and is used by the CPU 201. The RAM 203 serves as a work area for the CPU 201 and a temporary data storage area. The I/F 204 is connected to the host computer 300 and transmits image data. The conveyance controller 205 controls the spool motor 221 and the conveying motor 222, which drives the pair of sheet conveying rollers 105, via motor drivers 223 and 224. The print controller 206 controls the recording head 100 and the carriage 101 on the basis of the print data. A system bus 207 connects the CPU 201 to other components.

Figure 3:
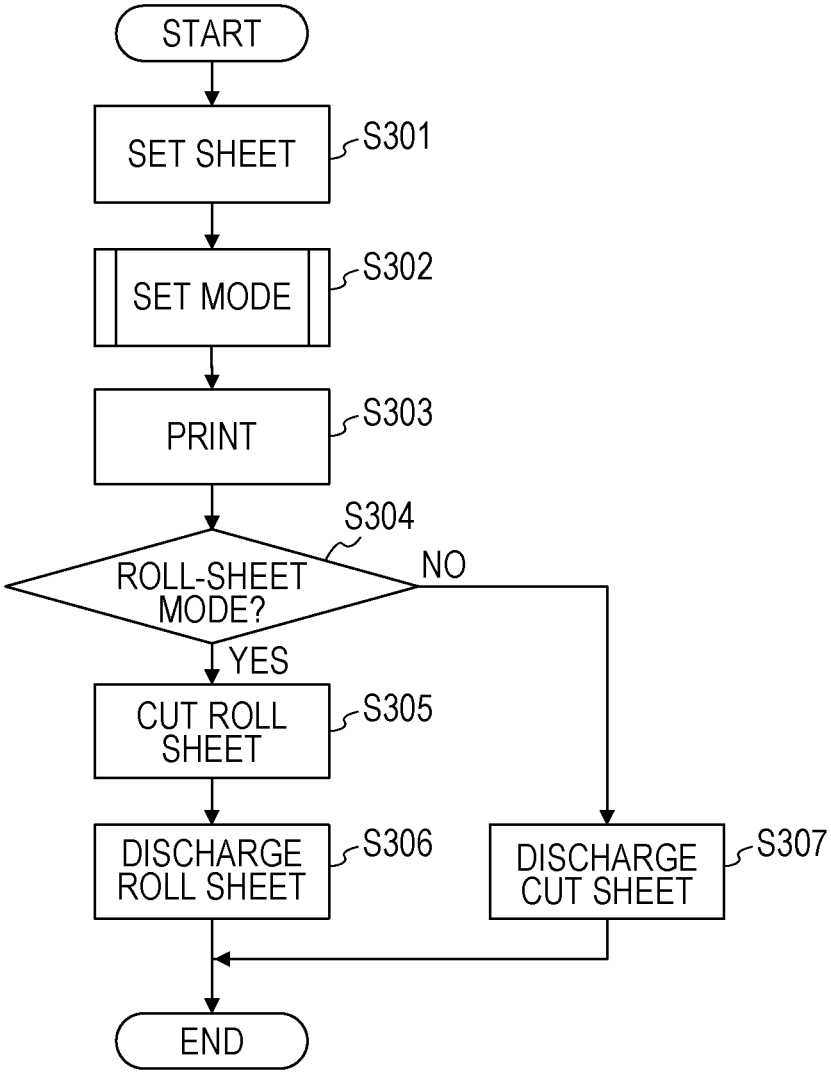
FIG. 3 is a flow chart illustrating the overall operation of the printer according to the embodiment of the present invention.

FIG. 3 is a flow chart illustrating the operation of the printer 200 according to the present embodiment. When the roll sheet 109 shown in FIG. 1A or the cut sheet 110 shown in FIG. 1B reaches a detecting position of the first sheet sensor 104, the pair of sheet conveying rollers 105 starts rotating so as to convey the sheet leftward. Subsequently, when the sheet is detected by the second sheet sensor 103, the pair of sheet conveying rollers 105 temporarily stops rotating, so that the sheet setting process is completed in step S301. In step S302, the operation mode is automatically set by a mode setting unit. In step S303, printing operation commences. When the printing operation is completed, it is determined in step S304 whether the set operation mode is the roll-sheet mode (first mode) or the cut-sheet mode (second mode). If it is determined that the set operation mode is the roll-sheet mode, a sheet cutting process is performed in step S305, and the roll sheet is discharged in step S306. On the other hand, if it is determined that the set operation mode is the cut-sheet mode, the cut sheet is discharged in step S307. The roll-sheet mode is an operation mode for performing printing on a roll sheet, whereas the cut-sheet mode is an operation mode for performing printing on a cut sheet. In the roll-sheet mode, the sheet cutter 106 is activated after the printing operation so that the printed portion of the roll sheet is cut off therefrom. In the cut-sheet mode, the printed cut sheet is discharged without activating the sheet cutter 106.

Figure 4:
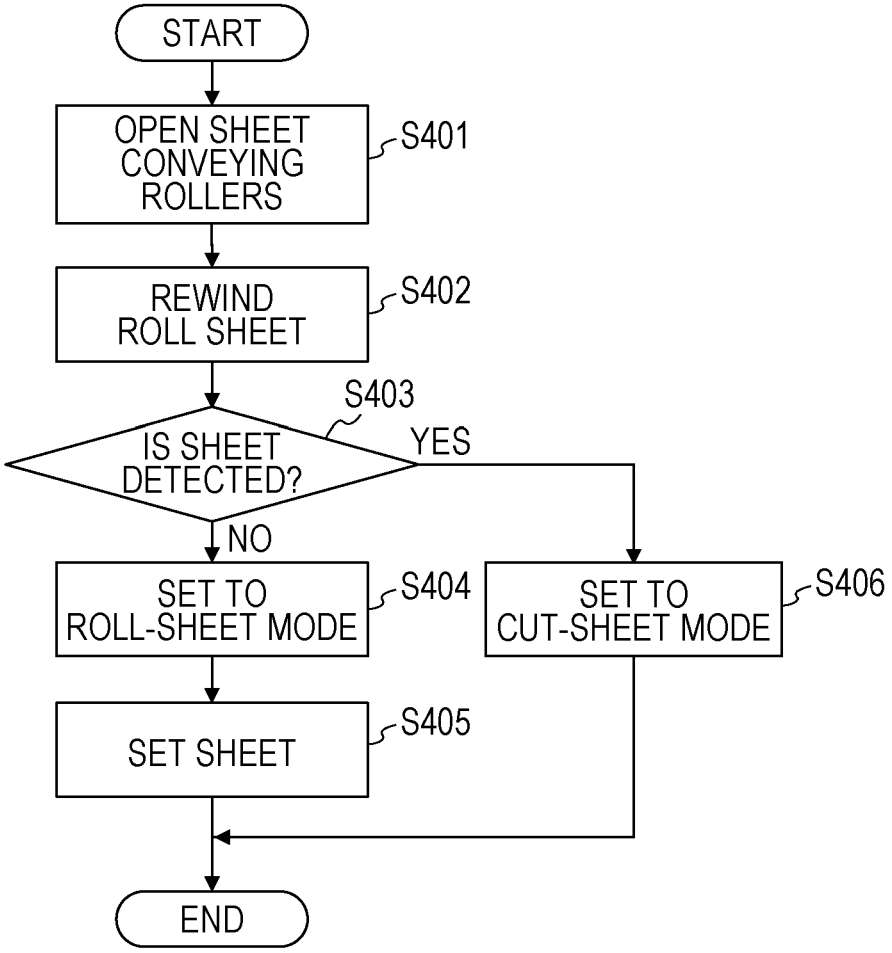
FIG. 4 is a flow chart illustrating a mode setting process in the printer according to the embodiment of the present invention.

The operation-mode setting procedure performed by the mode setting unit will now be described with reference to FIG. 4. When the sheet setting process is completed, the CPU 201 (see FIG. 2) moves one of the sheet conveying rollers 105 (see FIG. 1A) away from the other roller in step S401. Subsequently, in step S402, the roll-sheet conveying unit 107 (see FIG. 1A) rotates the rolled section 109*a* clockwise in response to a command from the conveyance controller 205 (see FIG. 2) having received a command from the CPU 201, so that the roll sheet 109 is rewound around the rolled section 109*a*. When the rewinding of the roll sheet 109 is completed, the CPU 201 detects whether there is a sheet present by using the second sheet sensor 103 in step S403, and sets the operation mode based on the detection result. Specifically, if a sheet is detected by the second sheet sensor 103, the CPU 201 sets the operation mode to the cut-sheet mode in step S406, whereas if a sheet is not detected, the CPU 201 sets the operation mode to the roll-sheet mode in step S404. If the roll-sheet mode is set, the sheet setting process is performed again in step S405.

It is also possible to rewind the roll sheet 109 without moving the sheet conveying rollers 105 away from each other. In other words, step S401 shown in FIG. 4 may be omitted. However, rewinding the roll sheet 109 after moving the sheet conveying rollers 105 away from each other can prevent scraping of the sheet.

Figure 5A:
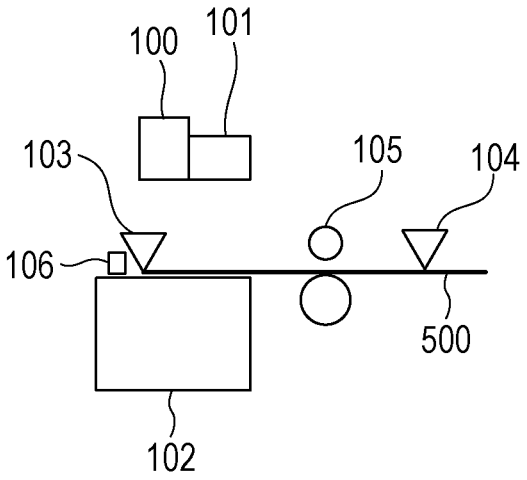
FIGS. 5A and 5B schematically illustrate a mode determining process in the printer according to the embodiment of the present invention.
Figure 5B:
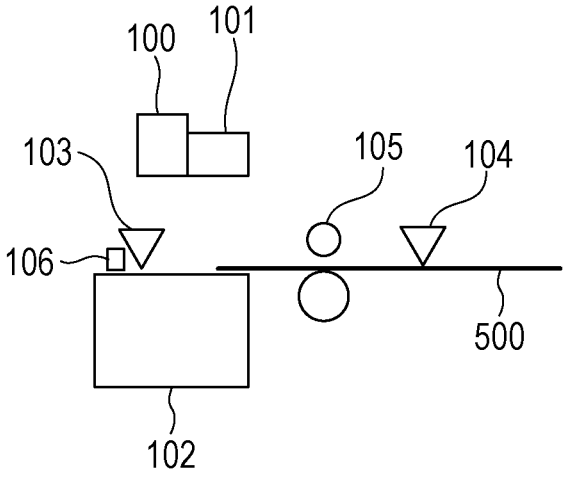

The operation mode setting method will be further described with reference to FIGS. 5A and 5B. When the sheet setting process (step S301 in FIG. 3) is completed as in FIGS. 1A and 1B, the leading edge of a sheet 500 is located at a position detectable by the second sheet sensor 103. Then, in step S401 in FIG. 4, the upper pinch roller of the pair of sheet conveying rollers 105 is lifted away from the lower conveying roller, as shown in FIG. 5A. When the roll-sheet rewinding process (step S402 in FIG. 4) is performed in this state, if the sheet 500 is a roll sheet, the sheet 500 moves rightward in conjunction with the rewound roll sheet 109. As a result, the leading edge of the sheet 500 moves (recedes) in accordance with the rewinding process of the roll sheet 109 to a position undetectable by the second sheet sensor 103, as shown in FIG. 5B. Consequently, when a sheet is not detected by the second sheet sensor 103, it is determined that the set sheet 500 is a roll sheet, and the roll-sheet mode is thus set.

When the second sheet sensor 103 switches from a sheet detectable state to a sheet undetectable state, the controller 210 determines that the sheet 500 has moved from a predetermined position and detects the movement of the sheet 500. Specifically, the controller 210 and the second sheet sensor 103 constitute a movement detecting unit. Therefore, in another exemplary embodiment, the second sheet sensor 103 that detects whether there is a sheet present may be replaced with a sensor that detects the movement of a sheet.

Alternatively, because the sheet 500 has moved as a result of the roll-sheet rewinding process, this also implies that the controller 210 has detected that the sheet 500 has moved in conjunction with the rewinding of the roll sheet. Specifically, the controller 210 and the second sheet sensor 103 constitute a conjunctional-movement detecting unit. Therefore, in another exemplary embodiment, the second sheet sensor 103 may be replaced with a sensor that monitors the movement of the rolled section 109*a* and the sheet 500 so as to detect conjunctional movement of the two.

On the other hand, if the set sheet 500 is a cut sheet, the sheet 500 does not move even when the roll-sheet rewinding process (step S402 in FIG. 4) is performed. Therefore, if a sheet is detected again by the second sheet sensor 103, it is determined that the set sheet 500 is a cut sheet, and the cut-sheet mode is thus set.

The roll-sheet conveying unit 107 shown in FIGS. 1A and 1B may alternatively have a roller that rotates in contact with the roll sheet, such that by rotating this roller in the forward or reverse direction, the roll sheet can be rotated in the unwinding direction or the rewinding direction of the roll sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-280375 filed Dec. 16, 2010, which is hereby incorporated by reference herein in its entirety.

What is claimed is:

1. A conveying device comprising:

a supporting unit configured to support a roll of a continuous sheet and configured to rotate the roll in a winding direction and an unwinding direction;

a conveying path configured to convey the continuous sheet from the roll or a cut sheet; and a controller that determines whether a sheet in the conveying path is the continuous sheet or the cut sheet depending on if the sheet moves or not while the roll is rotated in the winding direction.

2. The conveying device according to claim 1, wherein the controller determines that the sheet in the conveying path is the continuous sheet if the sheet moves, and wherein the controller determines that the sheet in the conveying path is the cut sheet if the sheet does not move.

3. The conveying device according to claim 1, wherein the controller sets a mode for cutting the sheet in the conveying path when the controller determines that the sheet is the continuous sheet and sets a mode for not cutting the sheet in the conveying path when the controller determines that the sheet is the cut sheet.

4. The conveying device according to claim 1, further comprising a sensor that detects a movement of the sheet in the conveying path, wherein the controller determines that the sheet in the conveying path is the continuous sheet if the sensor detects the movement of the sheet when the roll is rotated in the winding direction in the supporting unit.

5. The conveying device according to claim 1, further comprising a pair of rollers that nip and convey the sheet in the conveying path, wherein the pair of rollers does not nip the sheet when the controller performs the determination process.

6. A printer comprising:

the conveying device according to claim 1; and a recording device that performs recording on a sheet conveyed by the conveying device.

7. A printer that performs recording on a continuous sheet and a cut sheet, comprising:

a support unit configured to support a roll of a continuous sheet and configured to rotate the roll in a winding direction and an unwinding direction;

a detector that detects whether a sheet is present in a conveying section; and a controller that sets a first mode for performing printing on the continuous sheet or a second mode for performing printing on the cut sheet, wherein the controller sets the second mode if the sheet is detected by the detector after the roll is rotated in the winding direction by the supporting unit or sets the first mode if the sheet is not detected by the detector after the roll is rotated in the winding direction by the supporting unit.

8. The printer according to claim 7, wherein the support unit rotates a spool fitted in the roll so as to rotate the roll.

9. A conveying device comprising:

a supporting unit configured to support a roll of a continuous sheet;

a conveying unit configured to convey the continuous sheet;

a conveying path configured to guide the continuous sheet or a cut sheet;

a detector configured to detect whether a sheet in the conveying path is moved; and a controller configured to determine whether a sheet in the conveying path is the continuous sheet or the cut sheet;

wherein the controller determines that the sheet in the conveying path is the continuous sheet when the detector detects a movement of the sheet in the conveying path while the conveying unit conveys the continuous sheet to the roll, and the controller determines that the sheet in the conveying path is the cut sheet when the detector does not detect a movement of the sheet in the conveying path while the conveying unit conveys the continuous sheet to the roll.

10. A conveying device comprising:

a supporting unit configured to support a roll of a continuous sheet;

a conveying unit configured to convey the continuous sheet;

a conveying path configured to convey the continuous sheet or a cut sheet;

a detector that detects whether a sheet is present in the conveying path; and a controller configured to determine that a sheet in the conveying path is the continuous sheet if the sheet is not detected by the detector after the conveying unit conveys the continuous sheet to the roll.

11. The conveying device according to claim 10, wherein the controller determines that a sheet in the conveying path is the cut sheet if the sheet is detected by the detector after the conveying unit conveys the continuous sheet to the roll.

* * * * *